US008618942B1

(12) United States Patent
Billman

(10) Patent No.: US 8,618,942 B1
(45) **Date of Patent: *Dec. 31, 2013**

(54) EXTENDED SMOKE ALARM SYSTEM

(75) Inventor: Bradly J. Billman, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/603,036

(22) Filed: Sep. 4, 2012

Related U.S. Application Data

(63) Continuation of application No. 13/027,899, filed on Feb. 15, 2011, now Pat. No. 8,258,969, which is a continuation of application No. 12/777,851, filed on May 11, 2010, now Pat. No. 7,889,088, which is a continuation of application No. 11/781,715, filed on Jul. 23, 2007, now Pat. No. 7,719,433.

(51) Int. Cl.
*G08B 17/10* (2006.01)

(52) U.S. Cl.
USPC ..... 340/628; 340/632; 340/627

(58) Field of Classification Search
USPC ..... 340/628
See application file for complete search history.

(56) References Cited

U.S. PATENT DOCUMENTS 4,258,291 A * 3/1981 Scott et al. ..... 315/156
4,692,750 A * 9/1987 Murakami et al. ..... 340/588
4,737,770 A * 4/1988 Brunius et al. ..... 340/539.22
4,862,148 A * 8/1989 Kichline ..... 340/628
5,382,943 A * 1/1995 Tanaka ..... 340/539.22
5,663,714 A * 9/1997 Fray ..... 340/692
5,686,896 A * 11/1997 Bergman ..... 340/636.1
5,731,759 A * 3/1998 Finucan ..... 340/628
5,905,438 A * 5/1999 Weiss et al. ..... 340/636.1
5,969,437 A * 10/1999 Foerster ..... 307/66
6,121,885 A * 9/2000 Masone et al. ..... 340/628
6,124,796 A * 9/2000 Hincher ..... 340/628
6,154,130 A * 11/2000 Mondejar et al. ..... 340/521
6,690,288 B1 * 2/2004 Waddell ..... 340/692
6,703,930 B2 * 3/2004 Skinner ..... 340/539.11
6,838,988 B2 * 1/2005 Lennartz et al. ..... 340/539.26
6,851,612 B2 * 2/2005 Iasso et al. ..... 235/472.01
6,914,533 B2 * 7/2005 Petite ..... 340/628
7,161,483 B2 * 1/2007 Chung ..... 340/531
7,701,355 B1 * 4/2010 Billman ..... 340/628
7,714,734 B1 * 5/2010 Billman ..... 340/628

(Continued)

OTHER PUBLICATIONS

CDC "Fire Navigation" sheet citing Karter MH, 2006. Fire loss in the United States during 2005, abridged report. Quincy, MA: National Fire Protection Association (NFPA), Fire Analysis and Research Division (FARD); [online], [retrieved from the internet on Jul. 21, 2007 using <URL:http://www.cdc.gov/print.do?url+http%3A//www.cdc.gov/ncipc/factsheets/fire.htm].

(Continued)

*Primary Examiner* — Travis Hunnings
(74) *Attorney, Agent, or Firm* — Brooks, Cameron & Huebsch, PLLC

(57) ABSTRACT

An extended smoke alarm system and related methods are disclosed. In particular, embodiments of an extended smoke alarm system having wireless-signal-send-and-receive functionalities wherein the system includes one or more flashlights having at least wireless-signal-receiving functionality are detailed. Related methods for system use are also disclosed.

20 Claims, 6 Drawing Sheets

(56) References Cited

U.S. PATENT DOCUMENTS

| | | | | |
|---|---|---|---|---|
| 7,719,433 | B1 * | 5/2010 | Billman | 340/628 |
| 7,889,088 | B1 * | 2/2011 | Billman | 340/628 |
| 8,258,969 | B1 * | 9/2012 | Billman | 340/628 |
| 2003/0067386 | A1 * | 4/2003 | Skinner | 340/540 |
| 2004/0217857 | A1 * | 11/2004 | Lennartz et al. | 340/514 |
| 2006/0017579 | A1 * | 1/2006 | Albert et al. | 340/628 |
| 2006/0250260 | A1 * | 11/2006 | Albert et al. | 340/628 |
| 2009/0009346 | A1 * | 1/2009 | Hojmose et al. | 340/628 |
| 2011/0140868 | A1 * | 6/2011 | Hovang | 340/12.55 |

OTHER PUBLICATIONS

Ahrens, M. 2007. U.S. experience with smoke alarms and other fire detection/alarm equipment. Quincy, MA: NFPA FARD; [online], [retrieved from the internet on Jul. 21, 2007 using <URL:http://www.nfpa.org/assets/files/PDF/AlarmExSum.pdf].

Kidde Products, Combination Smoke & Carbon Monoxide Alarm with Voice Message System, Hugh, and Peak Level Memory User's Guide; Manual P/N 810-1512 Rev. G.

* cited by examiner

EXTENDED SMOKE ALARM SYSTEM

CROSS-REFERENCE TO RELATED APPLICATIONS

This application is a continuation of U.S. patent application Ser. No. 13/027,899, filed Feb. 15, 2011, now U.S. Pat. No. 8,258,969, which is a continuation U.S. patent application Ser. No. 12/777,851, filed on May 11, 2010, now U.S. Pat. No. 7,889,088, which is a continuation of U.S. patent application Ser. No. 11/781,715, filed on Jul. 23, 2007, now U.S. Pat. No. 7,719,433. This application is also related in subject matter to, and incorporates herein by reference in its entirety, each of the following: U.S. patent application Ser. No. 11/781,713, filed on Jul. 23, 2007, now U.S. Pat. No. 7,714,734, issued on May 11, 2010 and is entitled "Extended Smoke Alarm System"; and U.S. patent application Ser. No. 11/781,721, filed on Jul. 23, 2007, now U.S. Pat. No. 7,701,355, issued on Apr. 20, 2010, and is entitled "Extended Smoke Alarm System".

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

TECHNICAL FIELD

The disclosed embodiments relate generally to a smoke alarm system and, more particularly, to a smoke alarm system having wireless-signal-send-and-receive functionalities wherein the system includes a flashlight that has at least wireless-signal-receiving functionality.

BACKGROUND

According to year 2005 statistics from the Center for Disease Control and Prevention (CDC), deaths from fires and burns are the fifth most common cause of unintentional injury deaths in the United States. Approximately four out of five fire deaths in the United States in 2005 occurred in homes (CDC "Fire Navigation" sheet citing Karter M J, 2006. *Fire loss in the United States during* 2005, abridged report. Quincy, Mass.: National Fire Protection Association (NFPA), Fire Analysis and Research Division (FARD)). In 2005, fire departments responded to 396,000 home fires in the United States, and home fires claimed the lives of 3,030 people (not including firefighters) and injured another 13,825 people (not including firefighters) (CDC "Fire Navigation" sheet citing Karter, 2006). In 2005, residential fires caused nearly $7 billion in property damage (CDC "Fire Navigation" sheet citing Karter, 2006).

The death rate per 100 reported fires was twice as high in homes without a working smoke alarm as it was in homes where this protection was in place (Ahrens M, 2007. *U.S. experience with smoke alarms and other fire detection/alarm equipment*. Quincy, Mass.: NFPA FARD). If all homes in the United States had working smoke alarms, an estimated 890 lives could be saved annually, or just under one-third the annual fire death toll in the United States (Ahrens, 2007).

Furthermore, additional lives could likely be saved if the effectiveness of working smoke alarm systems were also increased. For example, even in homes where a working smoke alarm was in place, the death rate per 10,000 reported fires in years 2000-2004 was 55 [although the death rate was higher, 113, in homes that lacked a working smoke alarm] (Ahrens, 2007, providing page on "Smoke Alarms in Reported U.S. Home Fires" from NFPA FARD). Many home occupants among the 55 people who were killed per 10,000 reported fires in homes where a working smoke alarm was in place would NOT likely have been killed if the smoke alarm system had been more effective in warning home occupants of smoke or fire.

SUMMARY

Disclosed embodiments relate to an innovative smoke alarm system designed to be effective not only in providing a warning of smoke or fire to occupants of a home (or another building) but also in providing assistance (particularly in providing a light source) to occupants for escaping from potentially darkened sections of a home (or another building) damaged by smoke or fire. In particular, embodiments relate to a smoke alarm system having wireless-signal-send-and-receive functionalities wherein the system includes a hand-held flashlight (having at least wireless-signal-receiving functionality) that may also optionally include a sound alarm or a vibrator or both. In some embodiments, the wireless signal is a radio frequency (RF) signal. In some embodiments, the flashlight's main light source projects light (typically in a high intensity beam), and the flashlight's sound alarm emits a loud intermittent or continuous warning tone, when the hand-held device receives an activating wireless signal (i.e., a smoke-or-fire-triggered wireless signal). In some embodiments, a vibrator in the handheld flashlight vibrates the flashlight when the hand-held flashlight receives an activating wireless signal. In some embodiments, the hand-held flashlight additionally includes a remote control component for testing components of, or for programming, the system. In some embodiments, a remote control component is in a separate device of the extended smoke alarm system.

In some embodiments, the system includes a signal transmission component that transmits data on smoke or fire status to an offsite device (e.g., a device accessible to an offsite owner, an emergency responder or an insurance company—e.g., a homeowners insurance company). In addition to a smoke detector, the system, in some embodiments, also includes a heat detector or a carbon monoxide detector or both. Other devices of the system (i.e., in addition to one or more hand-held flashlights having wireless-signal-receiving functionality) may receive, and be activated by, a smoke-or-fire-triggered wireless signal. These devices may include a device worn by a home occupant as a head piece, necklace, belt, band, bracelet, anklet, or foot piece.

In some embodiments, an extended smoke alarm system for a home or other building is described, the extended smoke alarm system comprising: a smoke detector, in the home or other building, comprising a computing system supporting at least wireless-signal-sending functionality; and a flashlight having at least wireless-signal-receiving functionality, wherein, on detecting smoke or fire, the smoke detector transmits a wireless signal that is received at the flashlight and thereby activates the flashlight to do one or more of the following: project light, emit an alarm sound or warning tone, and vibrate.

In some embodiments, a related method is described for activating a flashlight that is part of an extended smoke alarm system for a home or other building, wherein the extended smoke alarm system further comprises a smoke detector, in the home or other building, comprising a computing system supporting at least wireless-signal-sending functionality, and wherein the flashlight has at least wireless-signal-receiving functionality, the method comprising: detecting smoke or fire near the smoke detector; transmitting a wireless-signal from the smoke detector; receiving the wireless-signal at the flashlight and thereby activating the flashlight to do one or more of the following: project light, emit an alarm sound or warning tone, and vibrate.

In some embodiments, a related computer-readable medium is described having computer-readable instructions stored thereon for transmitting a wireless signal for activating a flashlight that is part of an extended smoke alarm system, wherein that system further comprises a smoke detector comprising a computing system supporting at least wireless-signal-sending functionality, and wherein the flashlight has at least wireless-signal-receiving functionality, said computer-readable instructions comprising instructions for controlling transmitting a wireless signal from the smoke detector in response to the smoke detector detecting smoke or fire, wherein, on reception of the wireless signal at the flashlight, the flashlight is activated to do one or more of the following: project light, emit an alarm sound or warning tone, and vibrate.

In other embodiments, a computer-based system for providing security within a home or other building is described, wherein the system comprises: a network; a smoke detector comprising a first computing system, in the home or other building, supporting at least wireless-signal-sending functionality, and connecting to said network; and an offsite device comprising a second computing system connecting to said network, wherein said first computing system is configured to: detect smoke or fire near the smoke detector in the home or other building and, on detecting smoke or fire, transmit a wireless signal to activate a flashlight having at least wireless-signal-receiving functionality, and transmit data on smoke or fire status to the second computing system of the offsite device.

In other embodiments, a related method is described for providing security within a home or other building that is part of a computer-based system comprising: a network; a smoke detector comprising a first computing system, in the home or other building, supporting at least wireless-signal-sending functionality, and collecting to said network; and an offsite device comprising a second computing system connecting to said network, the method comprising: detecting smoke or fife near the smoke detector in the home or other building at the first computing system and, on detecting smoke or fire, transmitting a wireless signal from the first computing system to activate a flashlight having at least wireless-signal-receiving functionality, and transmitting data on smoke or fire status from the first computing system to the second computing system of the offsite device.

In other embodiments, a related computer-readable medium is described having computer-readable instructions stored thereon for providing security within a home or other building that is part of a computer-based system comprising: a network; a smoke detector comprising a first computing system, in the home or other building, supporting at least wireless-signal-sending functionality, and collecting to said network; and an offsite device comprising a second computing system collecting to said network, said computer-readable instructions comprising instructions for: detecting smoke or fife near the smoke detector in the home or other building at the first computing system and, on detecting smoke or fife, transmitting a wireless signal from the first computing system to activate a flashlight having at least wireless-signal-receiving functionality, and transmitting data on smoke or fire status from the first computing system to the second computing system of the offsite device.

In further embodiments, a computer-based system is described for providing security within a home or other building, the system comprising: a network; a smoke detector comprising a first computing system, in the home or other building, supporting at least wireless-signal-sending functionality and connecting to said network; an first offsite device comprising a second computing system connecting to said network; and an second off site device comprising a third computing system connecting to said network, wherein said first computing system is configured to: detect smoke or fire near the smoke detector within the home or other building and, on detecting smoke or fire, transmit a wireless signal to activate a flashlight having at least wireless-signal-receiving functionality, and transmit data on smoke or fire status of the home or other building to at least the second computing system of the first offsite device; and wherein said third computing system of the second offsite device is configured to receive data on smoke or fire status from the first computing system of the smoke detector or the second computing system of the first offsite device, or both.

In further embodiments, a related method is described for providing security within a home or other building that is part of a computer-based system comprising: a network; a smoke detector comprising a first computing system, within the home or other building, supporting at least wireless-signal-sending functionality, and connecting to said network; an first offsite device comprising a second computing system connecting to said network; and an second offsite device comprising a third computing system connecting to said network, the method comprising: detecting smoke or fire near the smoke detector in the home or other building and, on detecting smoke or fire, transmitting a wireless signal to activate a flashlight having at least wireless-signal-receiving functionality, and transmitting data on smoke or fire status of the home or other building to at least the second computing system of the first offsite device; and wherein said third computing system of the second offsite device is configured to receive data on smoke or fire status from the first computing system of the smoke detector or the second computing system of the first offsite device, or both.

In further embodiments, a related computer-readable medium is described having computer-readable instructions stored thereon for providing security within a home or other building that is part of a computer-based system comprising: a network; a smoke detector comprising a first computing system, within the home or other building, supporting at least wireless-signal-sending functionality, and connecting to said network; an first offsite device comprising a second computing system connecting to said network; and an second offsite device comprising a third computing system connecting to said network, said computer-readable instructions comprising instructions for: detecting smoke or fire near the smoke detector in the home or other building and, on detecting smoke or fire, transmitting a wireless signal to activate a flashlight having at least wireless-signal-receiving functionality, and transmitting data on smoke or fire status of the home or other building to at least the second computing system of the first offsite device; and wherein said third computing system of the second offsite device is configured to receive data on smoke or fire status from the first computing system of the smoke detector or the second computing system of the first offsite device, or both.

BRIEF DESCRIPTION OF THE DRAWINGS

The foregoing and other advantages will become apparent from the following detailed description and upon reference to the drawings, wherein.

DETAILED DESCRIPTION

Following is a detailed description with reference to the drawings wherein the same reference label, are used for the same or similar elements. As used throughout this description and the claims, the terms "a" and "an" are intended to mean "one or more."

Figure 1:
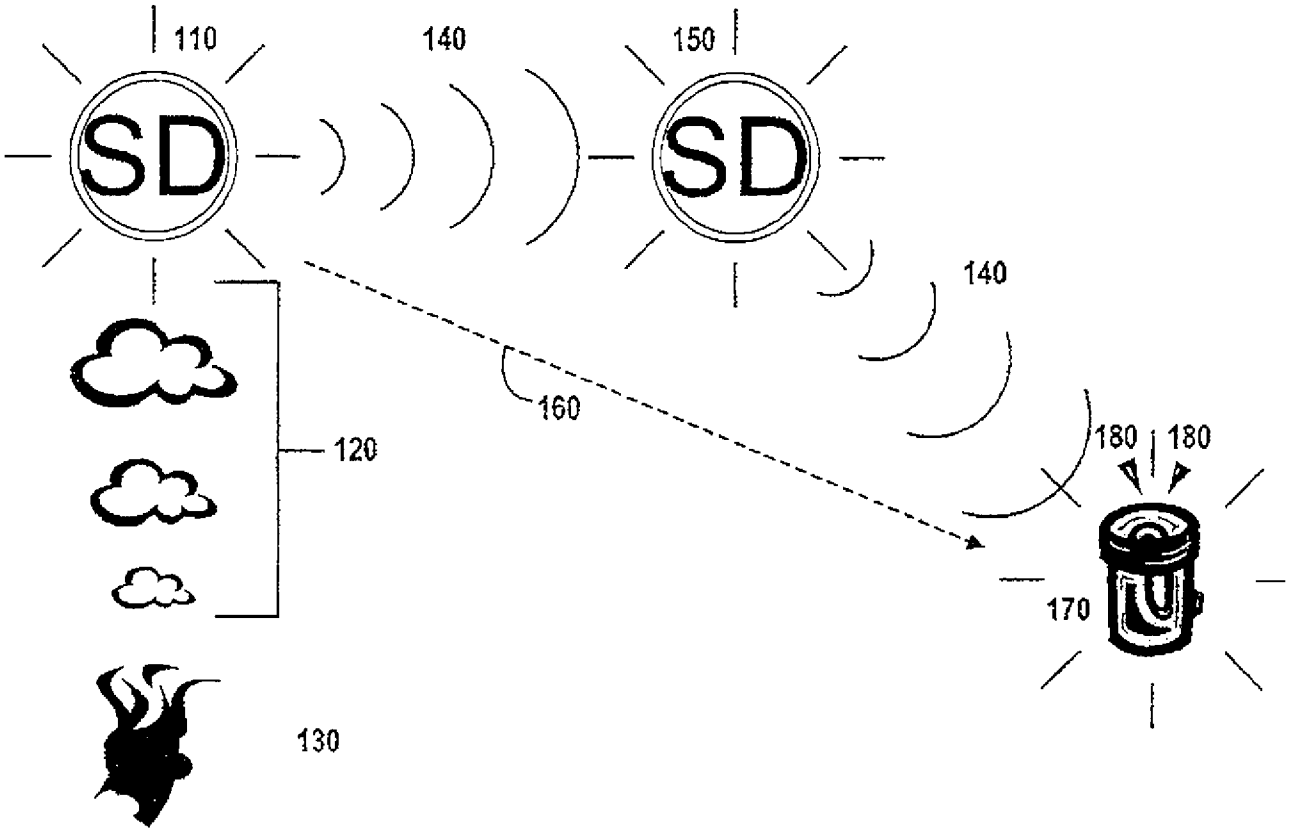
FIG. 1 illustrates a basic embodiment of components of an extended smoke alarm system.

Referring to FIG. 1, basic embodiments of home components of an extended smoke alarm system are illustrated. Smoke detector 110 detects heat or smoke 120 from fire 130. The smoke detector may be an ionization chamber-type detector (e.g., as in some dual-chamber types with sensors for both visible and invisible products of combustion, and with smoke entry allowed over 360 degrees in air velocities of up to 2000 FPM, i.e., 10 m/s), a photoelectric-type detector (e.g., with sensors designed to detect flaming and smoldering conditions, and with smoke entry allowed over 360 degrees in air velocities of up to 4000 FPM, i.e., 20 m/s), or another kind of smoke detector. When activated, a sound alarm of smoke detector 110 emits a loud intermittent or continuous warning tone to alert occupants in the home or other building, e.g., a storage building, shop or office building, of the smoke or fire. In some embodiments, the "warning tone" may emulate a human voice and loudly repeat "FIRE" or some other recorded message of warning. Smoke detector 110, in some embodiments, is wired into the electrical power system of the home or other building in which it is installed, but smoke detector 110 may also include a battery power system as a backup. In some embodiments, smoke detector 110 relies simply on an internal or external battery power system.

Smoke detector 110 also transmits wireless signals 140 to one or more other smoke detectors, such smoke detector ISO, which in response each also emits intermittent or continuous warning tones, which may be the same, similar or different from those warning tones emitted by smoke detector 110—for example, the warning tone may be tailored to the smoke detector's location within the home or other building. Smoke detector 110 and smoke detector 150 additionally transmit wireless signals 140 to one or more hand-held flashlights like wireless-signal-receiving-hand-held flashlight 170. Wireless signal transmission from smoke detector 110 to flashlight 170 may also be direct, as indicated by dashed line 160. In some embodiments, wireless signal transmission is particularly extended, e.g., having a range beyond smoke detectors in the same plane in the same room or adjacent rooms, and including smoke detectors and other wireless-signal-receiving devices at different levels in the same or adjacent rooms or even including, in some embodiments, smoke detectors and other wireless-signal-receiving devices in surrounding buildings. In some embodiments, the wireless signal is a signal of a radio frequency (RF), microwave, infrared (IR), visible light, ultraviolet light, or a signal of some other frequency on the electromagnetic spectrum.

A wireless-signal-receiving flashlight, like hand-held flashlight 170, may be placed in a multiplicity of locations—such as mounted on the wall of a room, kept on or near an occupant of the home, or left unsecured, e.g., on top of a study table. When a wireless signal activates hand-held flashlight 170, light beams 180 project from flashlight 170 with an intensity that would be helpful to someone holding the flashlight to visualize passageways in spite of encroaching smoke or darkness. In addition in some embodiments, when a wireless signal activates hand-held flashlight 170, an alarm of flashlight 170 sounds—e.g., the alarm, like an alarm of smoke detector 110 or 150, also emits a loud intermittent or continuous warning tone, which, in some embodiments, like a warning tone of smoke detector 110 or 150, may also emulate a human voice and loudly repeat "FIRE" or some other recorded message of warning.

Hand-held flashlight 170 may also be equipped with an internal vibrator (not shown) and respond to wireless signals by causing flashlight 170 to vibrate until deactivated. The extended smoke alarm system may also include a wireless-signal-receiving device other than a conventionally-styled flashlight, and a light, sound alarm, or vibrator may also be included in that device and provide a further means to warn an occupant—e.g., a deaf occupant through vibrations, i.e., by the sense of touch—of smoke or fire in a home or another building type. In various embodiments, a wireless-signal-receiving flashlight or another wireless-signal-receiving device may be worn by a occupant, e.g., as a head piece or foot piece, or on a necklace, a bracelet, a band (e.g., around the upper arm, a finger or toe), a belt (e.g., around the chest, waist or thigh) or an anklet strap.

Figure 2B:
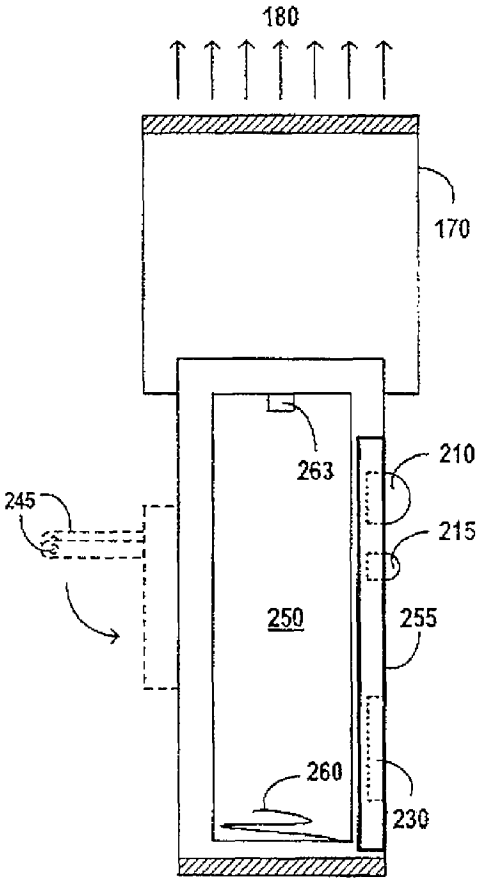
FIG. 2B illustrates a side view, and some internal aspects, of a basic embodiment of a hand-held flashlight having wireless-signal-receiving functionality.
Figure 2A:
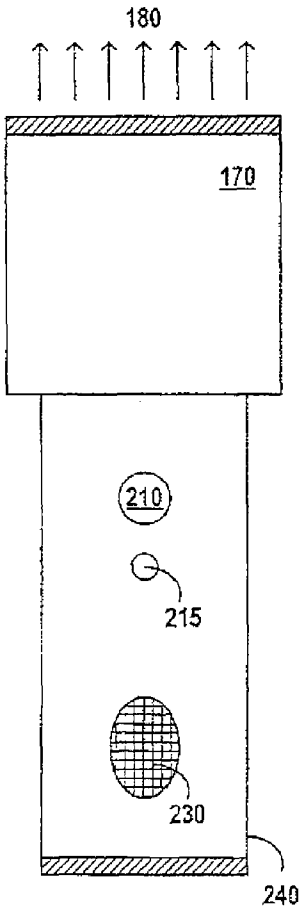
FIG. 2A illustrates a top external view of a basic embodiment of a hand-held flashlight having wireless-signal-receiving functionality.

Referring to FIG. 2A (a top external view) and FIG. 2B (a side view with some internal aspects depicted), basic embodiments of hand-held flashlight 170 having wireless-signal-receiving functionality are illustrated. The main lamp of flashlight 170 projects light 180 typically in a high intensity beam. ON & OFF switch 210 is part of an electrical circuit that includes the main lamp. Reset button 215 includes, in some embodiments, a low-battery-indicating lamp (not shown). In some embodiments, an operator may depress reset button 215 in order to switch flashlight 170 or another wireless-signal-receiving device into a "Receive Program" mode (discussed later). Audio output component 230 includes a small speaker, e.g., a piezoelectric speaker or other compatible device, that emits an alarm sound or warning tone when the flashlight is activated on receiving wireless signals from smoke detector 150, or smoke detector 110. In some embodiments, casing or shell 240 is composed of a hard, high-impact-resistant, heat-resistant plastic that also encloses battery chamber 250. The battery chamber in some embodiments includes spring 260 so that batteries inserted into the battery chamber remain in conductive contact with spring 260 and opposite electrical contact 263.

As further illustrated in FIG. 2B, wireless-signal-receiving-hand-held flashlight 170 in some embodiments may be designed to plug into an electrical wall outlet using electrical socket prongs 245; FIG. 2B illustrates retractable embodiments of prongs 245. The hand-held flashlight may more easily be kept charged if it includes a rechargeable battery. Access to a wireless-signal-receiving hand-held flashlight of an extended smoke alarm system, particularly under emergency conditions, likely would generally be more limited if the flashlight were kept plugged into an electrical outlet on a wall. Furthermore, a deaf occupant would not feel a vibration-based warning if the flashlight, or other wireless-signal-receiving device, were not kept in contact with the deaf occupant, e.g., as a belt attachment, but instead were largely kept plugged into an electrical outlet.

In the embodiment shown in FIG. 2B, much of the circuitry for controlling the flashlight is located in "control" section 255, which is represented by a rectangle defined by a dark-line border in FIG. 2B, and which, in the embodiment shown, physically contains ON & OFF switch 210, reset button 215, and audio output component 230 (control circuitry generally not shown). A surface level layer of audio output component 230 porously covers a small speaker, e.g., a piezoelectric speaker or other compatible device, that emits an alarm sound or warning tone when the flashlight is activated on receiving wireless signals, e.g., from smoke detector 150 or directly from smoke detector 110, as shown by dashed line 160 of FIG. 1, or from some other source.

In some embodiments, reset button 215 may include, as previously noted, a low-battery-indicating lamp (not shown). In some embodiments, reset button 215 may also act as a program-receptivity button for flashlight 170. That is, if an operator depresses reset button 215 for an extended period, such as several seconds, a secondary circuit is activated, e.g., in association with wireless-signal-receiving circuit 280 of FIG. 2C (described later), that places flashlight 170 in "Receive and Program" mode. In this mode, a programming remote control (also described later) may be used to set a frequency programming circuit (also described later) of flashlight 170, which then is programmed to respond to wireless signals of a specific kind, such as RF signals defined by frequency or amplitude or both.

Figure 2C:
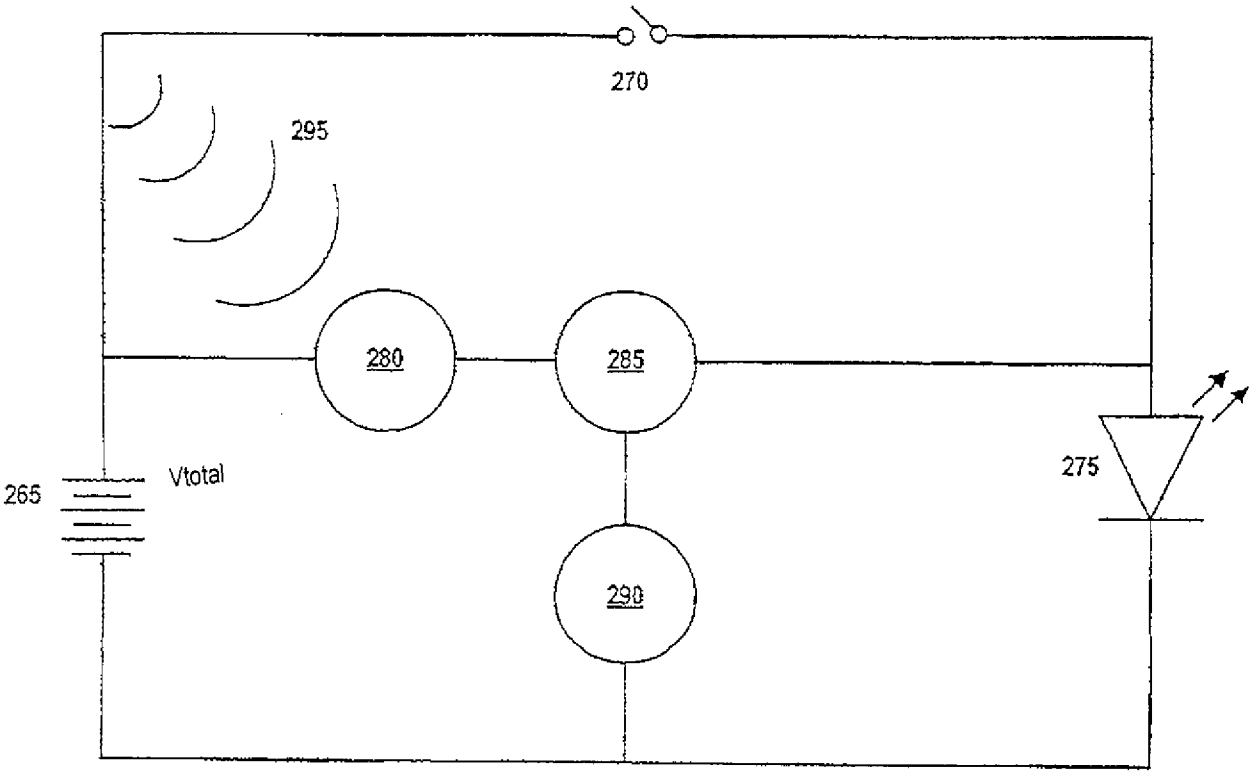
FIG. 2C provides a high-level circuit diagram for an embodiment of a handheld flashlight having wireless-signal-receiving functionality.

Referring to FIG. 2C, a high-level circuit diagram of an embodiment of the control and output circuitry of a wireless-signal-receiving-hand-held flashlight 170 is provided. Base voltage source 265 (i.e., in some embodiments, "Vw" (is 4.5 volts) powers the overall circuit. Main switch 270 may be closed manually in order to complete the circuit and turn the flashlight "ON." When a smoke detector transmits wireless signal 295, the wireless-signal-receiving circuit 280 of the flashlight receives the signal, converts it to a DC signal, and routes it to control circuit 285. Once received, the signal "turns on" or switches circuit 285 and provides a by-pass to manually operated main switch 270. Once circuit 285 is activated, circuit 290 is in turn activated and the flashlight's main lamp 275 is switched "ON" to project light 180, the flashlight's speaker emits an alarm sound or warning tone—if a speaker is included in the embodiment of the flashlight—and the flashlight vibrates—if a vibrator is included in the embodiment of the flashlight.

In some embodiments, wireless-signal-receiving circuit 280 also functions as a frequency programming circuit that is responsive to programming data from programming remote control (described later in more detail). That is, once frequency programming circuit 280 of flashlight 170 receives, and is activated by, programming data from a control device, e.g., like programming remote control 340 of FIG. 3B, flashlight 170 is programmed to respond to wireless signals of a specific kind, such as RF signals defined by frequency or amplitude or both. In this way, a wireless-signal-receiving-hand-held flashlight 170 (or other wireless-signal receiving device) may be programmed for reception of wireless signals of a specific kind. After programming, once wireless-signal-receiving circuit 280 receives an activating wireless signal of a specific program-compatible kind, control circuit 285 is activated, and, with circuit 290 in turn being activated, flashlight 170's main lamp 275 is triggered "ON" as are, optionally, flashlight 170's speaker (if present) and vibrator (if present). In some embodiments, an wireless-signal-receiving-hand-held flashlight 170 also includes as an integrated component an wireless-signal-transmitting basic remote control or a wireless-signal-transmitting programming remote control (each described in more detail below).

Figure 3A:
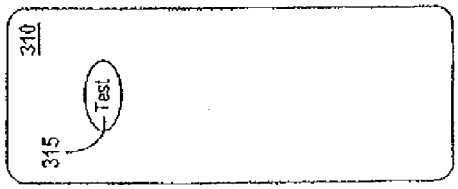
FIG. 3A illustrates an embodiment of a basic remote control for testing a wireless-signal-receiving smoke detector or flashlight, or both, for functionality.

Referring to FIG. 3A, an embodiment of a wireless-signal-sending basic remote control 310 for testing a wireless-signal-receiving smoke detector or flashlight, or both, for functionality is illustrated. Remote control 310 may transmit a wireless signal that may be received by smoke detector 110, smoke detector ISO, flashlight 170 or other wireless-signal-receiving device of an extended smoke alarm system. When an occupant within range of the wireless-signal-receiving device aims remote control 310 at the smoke detector, flashlight or other device and pushes test button 315, the target smoke detector, flashlight or other device will respond by projecting light—if, as for flashlight 170, a wireless-signal responsive lamp or light is included in the embodiment, emitting an alarm sound or warning tone—if a speaker is included in the embodiment, and vibrating—if a vibrator is included in the embodiment.

Figure 3B:
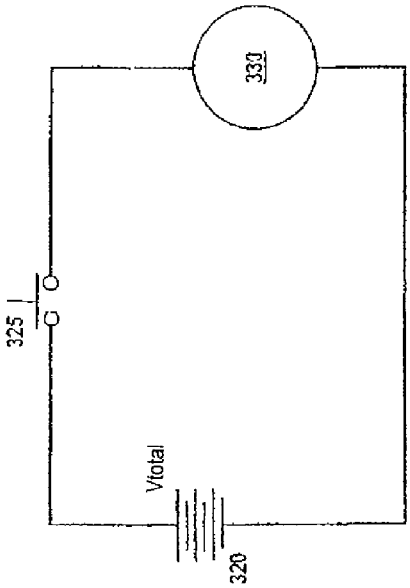
FIG. 3B provides a high-level circuit diagram for an embodiment of a basic remote control.

Referring to FIG. 3B, a high-level circuit diagram for an embodiment of a basic remote control is provided. A power or voltage source 320 provides electrical power to a wireless-transmitting circuit 330 on the closing of a momentary button or switch 325. Wireless signals emitted from the wireless-transmitting circuit 330 of basic remote control 310 trigger a test device response, e.g., light, alarm sound or warning tone, or vibration, if the test device, e.g., smoke detector, flashlight, or other wireless-signal receiving device, is functioning.

Figure 3C:
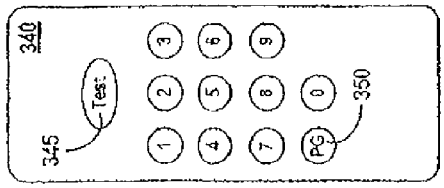
FIG. 3C illustrates an embodiment of a programming remote control for testing a wireless-signal-receiving smoke detector or a flashlight, or both, for functionality.

Referring to FIG. 3C, an embodiment of an programming remote control for testing a wireless-signal-receiving smoke detector, flashlight or other device for functionality is illustrated. Like remote control 310, programming remote control 340 may transmit a wireless signal that may in turn be received by smoke detector 110, smoke detector 150, flashlight 170, or other wireless-signal-receiving device of an extended smoke alarm system. Similarly, when an occupant within range of the wireless-signal-receiving device aims programming remote control 340 at the device and pushes test button 345, the target smoke detector, flashlight or other device will respond by projecting light—if, as for flashlight 170, a wireless-signal responsive light is included in the embodiment, emitting an alarm sound or other warning tone—if a speaker is included in the embodiment, and vibrating—if a vibrator is included in the embodiment.

However, in some embodiments, the programming remote control 340 may output more than one frequency used by wireless-signal-receiving/transmitting smoke detectors or other wireless-signal-receiving/transmitting devices. In some embodiments, the programming remote control 340 may also be used not only simply to test, but also to program, a smoke detector, a flashlight, or other wireless-signal-receiving or transmitting device (as previously noted). In some embodiments of a resident keypad configuration, a keypad made up of buttons, like the "PG' or "program" button 350, is used for data input.

Figure 3D:
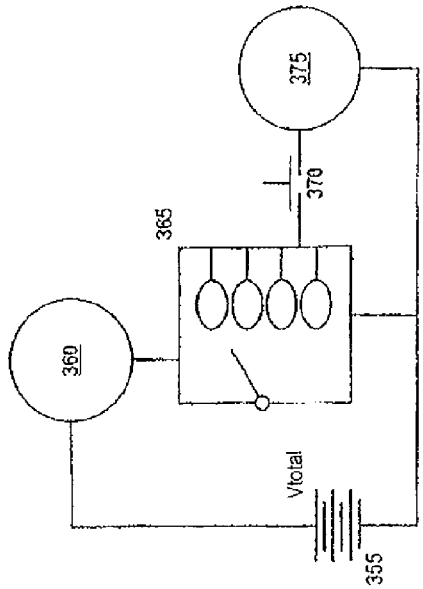
FIG. 3D provides a high-level circuit diagram for an embodiment of a programming remote control.

Referring to FIG. 3D, a high-level circuit diagram for an embodiment of a programming remote control is provided. A keypad circuit 360 is used for data input to a data selector circuit 365, which selects the proper circuit or setting for frequency generation for a particular extended smoke alarm system setup. Once proper circuit or setting parameters are programmed and the circuit of the programming remote control is activated, e.g., by depressing "Test" keypad 345 depicted in FIG. 3C and closing switch 370, an output wireless signal is emitted via an antennae circuit 375. In this way, the programming remote control may be used for programming and testing wireless-signal receiving devices such as hand-held flashlight 170.

In some embodiments, hand-held flashlight 170 is programmed to be responsive to specific wireless signals such as specific RF signals defined by frequency or amplitude or both. Just as smoke detectors, in some embodiments, may be programmed to receive or transmit or be responsive to only specific wireless signals, hand-held flashlight 170 or some other wireless-signal receiving device may, in some embodiments, be programmed to receive or transmit or be responsive to only specific wireless signals such as specific RF signals defined by frequency or amplitude or both.

Figure 4:
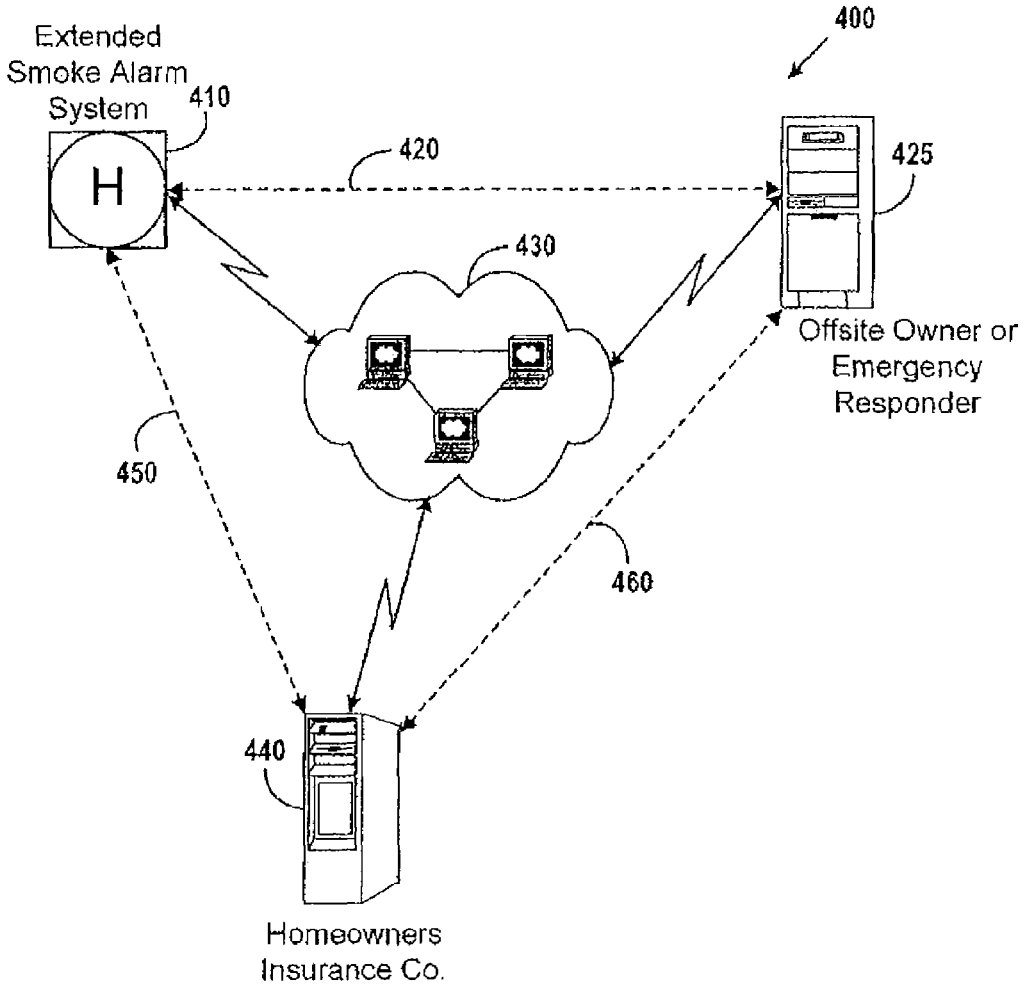
FIG. 4 illustrates an extended smoke alarm system as a component of a larger home security network wherein some possible interactions between the extended smoke alarm system, an offsite owner or an emergency responder computer system, and a homeowners insurance company computer system are illustrated.

Referring to FIG. 4, an extended smoke alarm system 410 is represented as a component of a larger home security network 400 wherein some possible interactions between the extended smoke alarm system 410, an offsite owner or emergency responder computing system 425, and a computing system 440 of a homeowners insurance company are illustrated. Though the computing system 440 is depicted as being a computing system of a homeowners insurance company, the computing system could be of any entity receiving data on smoke or fire status from a computing system of an extended smoke alarm system 410 or a computing system 425 of an offsite owner or emergency responder.

The extended smoke alarm system 410 of the home security network 400 may be connected to an offsite owner or emergency responder computing system 425 over a communications network 430 or directly via dedicated line(s) 420. Similarly, in some embodiments, extended smoke alarm system 410 may be connected to computing system 440 of a homeowners insurance company over communications network 430 or directly via dedicated line(s) 450, and an offsite owner or emergency responder computing system 425 may be connected to computing system 440 of a homeowners insurance company over communications network 430 or directly via dedicated line(s) 460. The communications network 430 may be a private network or a public network (e.g., the Internet). Computing systems 425 and 440—as well as extended smoke alarm system 410, which also is a computing system—may be based on any type of computer or computing device suitable for that system's particular requirements, including a mainframe computer, workstation computer, server, desktop computer, laptop computer, cell phone, personal digital assistant (PDA), and the like, although, in particular for the smoke alarm system 410, circuitry of some computing devices may be relatively simplistic.

The connection between the communications network 430, a computing system of extended smoke alarm system 410, and various computing systems 425 and 440 may be any suitable network connection, including a wired connection, wireless connection, and/or a combination of both. In some embodiments, communications between a computing system of extended smoke alarm system 410, and various computing systems 425 or 440, or both computing systems 425 and 440, via communications network 430, are over a cell service network or cellular network, which, in some embodiments, may also carry signals between components of extended smoke alarm system 410. For simplicity, connections are shown in FIG. 4 as a double-headed arrow between the communications network 430 and a computing system of extended smoke alarm system 410, as well as each computing system 425 and 440. Note also that although only a single extended smoke alarm system 410, offsite owner or emergency responder computing system 425, and computing system 440 of a homeowners insurance company, are shown in FIG. 4, those having ordinary skill in the art will understand that multiple instances of each type of computing systems may be present and connected to one another over dedicated line(s) 420, 450, and 460, or via communications network 430. Furthermore, if only dedicated line(s) 420, 450, and 460 connect, respectively, extended smoke alarm system 410 and computing system 425, extended smoke alarm system 410 and computing system 440, and computing system 425 and computing system 440, the dedicated lines would then form a network without communications network 430.

If smoke or fire triggers a warning response in a smoke detector that is part of an extended smoke alarm system, in embodiments of home security network 400, a signal transmission component (not shown) of extended smoke alarm system 410 transmits data on smoke or fire status to an offsite device, e.g., such as computing system 425 or other device accessible to an offsite owner or an emergency responder, or such as computing system 440 of a homeowners insurance company. The data on smoke or fire status may be transmitted in any form acceptable to a desired number of component devices. In particular, data on smoke or fire status received by computing system 440 of a homeowners insurance company may be used by the insurance company with other similar data for actuarial analysis, e.g., in order to refine rates on homeowners insurance policies.

Figure 5:
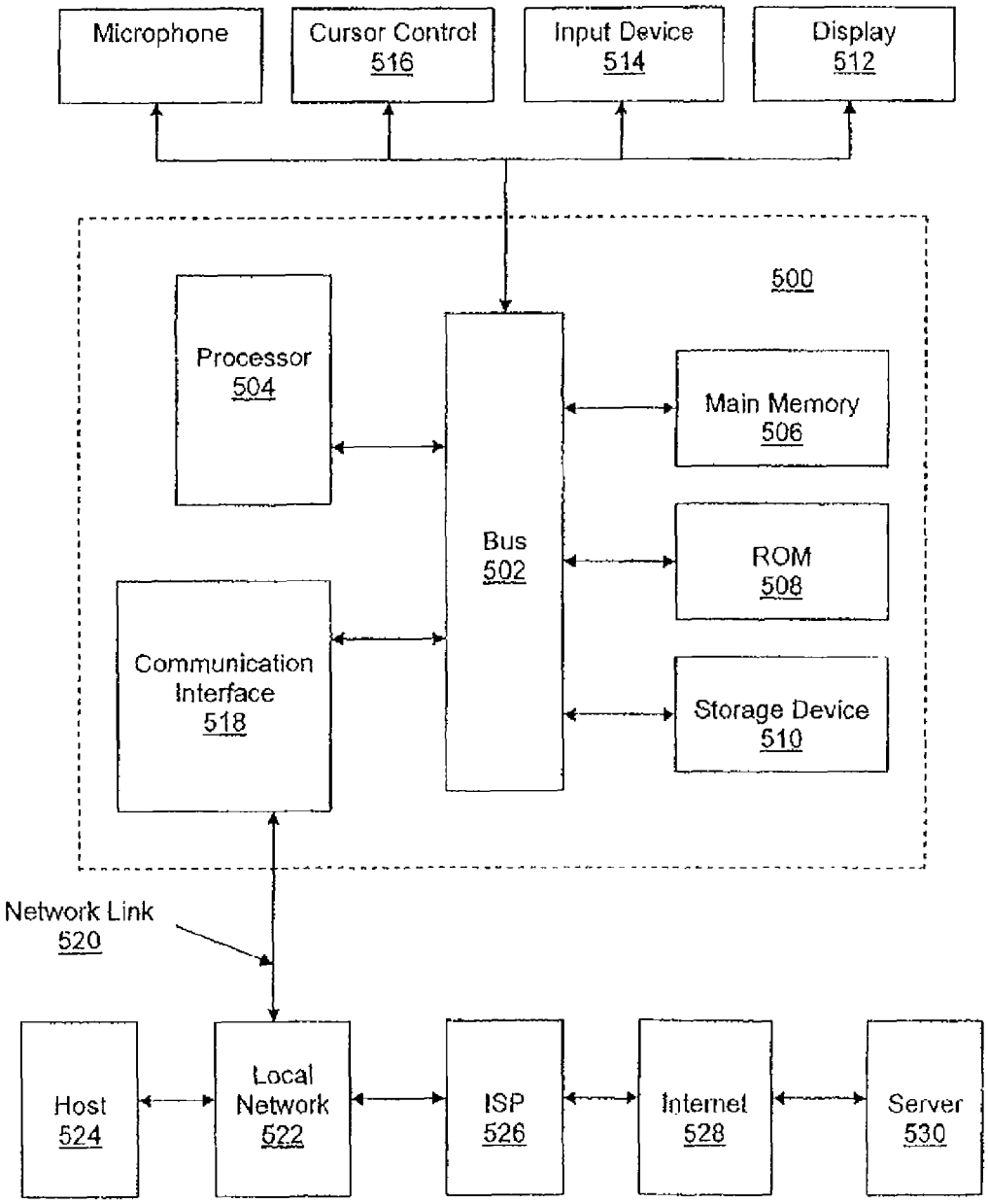
FIG. 5 illustrates, in block diagram form, a computer system upon which a system embodiment may be implemented, or reside, in whole or in part.

Referring to FIG. 5, a block diagram illustrates an exemplary computer or computing system 500 upon which process flows in accordance with principles of embodiments may be implemented or on which embodiments themselves may reside. Computer or computing system 500 includes a bus 502 or other communication mechanism for communicating information, and a processor 504 coupled with bus 502 for processing information. Computer or computing system 500 also includes a main memory 506, such as a random access memory (RAM) or other dynamic storage device, coupled to bus 502 for storing information and instructions to be executed by processor 504. Main memory 506 also may be used for storing temporary variables or other intermediate information during execution of instructions to be executed by processor 504. Computer or computing system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

Computer or computing system 500 may be coupled via bus 502 to a display 512, such as a cathode ray tube (CRT), for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. This input device typically has two degrees of freedom in two axes, a first axis (e.g., x) and a second axis (e.g., y), that allows the device to specify positions in a plane.

One or more populating acts may be provided by computer or computing system 500 in response to processor 504 executing one or more sequences of one or more instructions contained in main memory 506. Such instructions may be read into main memory 506 from another computer-readable medium, such as storage device 510. Execution of the sequences of instructions contained in main memory 506 causes processor 504 to perform processes described herein. One or more processors in a multiprocessing arrangement may also be employed to execute the sequences of instructions contained in main memory 506. In other embodiments, hard-wired circuitry may be used in place of, or in combination with, software instructions. Thus, embodiments are not limited to any specific combination of hardware circuitry and software.

The term "computer-readable medium" as used herein refers to any medium that participates in providing instructions to processor 504 for execution. Such a medium may take many forms, including but not limited to, non-volatile media, volatile media, and transmission media. Non-volatile media include, for example, optical or magnetic disks, such as storage device 510. Volatile media include dynamic memory, such as main memory 506. Transmission media include coaxial cables, copper wire and fiber optics, including the wires that comprise bus 502. Transmission media can also take the form of acoustic or, on the electromagnetic spectrum, light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 504 for execution. For example, the instructions may initially be borne on a magnetic disk of a remote computer. The remote computer can load the instructions into its dynamic memory and send the instructions over a telephone line using a modem. A modem local to computer system 300 can receive the data on the telephone line and use an infrared transmitter to convert the data to an infrared signal. An infrared detector coupled to bus 502 can receive the data carried in the infrared signal and place the data on bus 502. Bus 502 carries the data to main memory 506, from which processor 504 retrieves and executes the instructions. The instructions received by main memory 506 may optionally be stored on storage device 510 either before or after execution by processor 504.

Computer or computing system 500 also includes a communication interface 518 coupled to bus 502. Communication interface 518 provides a two-way data communication coupling to a network link 520 that is connected to a local network 522. For example, communication interface 518 may be an integrated services digital network (ISDN) card or a modem to provide a data communication connection to a corresponding type of telephone line. As another example, communication interface 518 may be a local area network (LAN) card to provide a data communication connection to a compatible LAN. Wireless links may also be implemented. In any such implementation, communication interface 518 sends and receives electrical, electromagnetic or optical signals that carry digital data streams representing various types of information.

Network link 520 typically provides data communication through one or more networks to other data devices. For example, network link 520 may provide a connection through local network 522 to a host computer 524 or to data equipment operated by an Internet Service Provider (ISP) 526. ISP 526 in turn provides data communication services through the worldwide packet data communication network, now commonly referred to as the "Internet" 528. Local network 522 and Internet 528 both use electrical, electromagnetic or optical signals that carry digital data streams. The signals through the various networks and the signals on network link 520 and through communication interface 318, which carry the digital data to and from computer or computing system 500, are exemplary forms of carrier waves transporting the information.

Computer or computing system 500 can send messages and receive data, including program code, through the network(s), network link 520, and communication interface 518. In the Internet example, a server 530 might transmit a requested code for an application program through Internet 528, ISP 526, local network 522 and communication interface 518. One such application program may provide for, or participate in, sending or receiving data [e.g., reporting on the activation of a smoke detector (or on smoke or fire status, or other related information) as described herein for various embodiments 1 to or from an offsite device. The received code may be executed by processor 504 as it is received, and/or stored in storage device 510, or other nonvolatile storage for later execution. In this manner, computer or computing system 500 may obtain application code in the form of a carrier wave.

Again, following long-standing patent law convention, the terms "a" and "an" mean "one or more" when used in this application, including the claims.

While the detailed description has been described with reference to one or more particular embodiments, those skilled in the art will recognize that many changes may be made thereto without departing from the spirit and scope of the description. For example, although the detailed description has been described in the context of an extended smoke alarm system that includes at least one hand-held flashlight having wireless-signal-receiving functionality as being an exemplary embodiment, the disclosed embodiments may equally be applicable to other arrangements of devices, e.g., wherein a bracelet or necklace vibrates on a deaf wearer after the device receives wireless signals from a smoke detector of the system.

What is claimed:

1. A system comprising:

a detector including a computing system supporting at least wireless-signal-sending-and receiving functionalities and configured to detect the presence of a particular stimulus, wherein on detecting the presence of the particular stimulus, the detector transmits a wireless activation signal; and a portable device having at least wireless-signal-receiving functionality, wherein, the portable device comprises a remote control component for testing the detector to determine whether the detector is functioning, and wherein the wireless activation signal is received by the portable device to activate a continuous projection of light from the portable device in response to receipt of the wireless activation.

2. The system of claim 1, wherein the wireless activation signal that is transmitted to and received by the portable device activates at least one of:

a sound alarm from the portable device in response to receipt of the wireless activation signal by the portable device; and vibration of the portable device in response to receipt of the wireless activation signal by the portable device, wherein the vibration of the portable device continues until an input to deactivate the vibrations is received.

3. The system of claim 1, wherein the remote control component of the portable device can be used to program one or more components of the system.

4. The system of claim 3, wherein the remote control component is configured to program the detector such that the detector responds to wireless activation signals of a specific kind.

5. The system of claim 3, wherein the remote control component is configured to program the detector such that the detector only responds to wireless activation signals having a specific frequency.

6. The system of claim 1, wherein the detector comprises at least one of a smoke detector and a carbon monoxide detector.

7. A system comprising:

a detector including a first computing system supporting wireless-signal-sending-and receiving functionalities and configured to detect the presence of a particular stimulus; and an offsite device comprising a second computing system and having at least wireless-signal-receiving functionality;

wherein on detecting the presence of the particular stimulus, a signal transmission component of the detector transmits data on a status corresponding to the particular stimulus to the offsite device.

8. The system of claim 7, wherein the offsite device is a device accessible to an offsite owner or an emergency responder.

9. The system of claim 7, wherein the offsite device is a cell phone.

10. The system of claim 7, wherein the offsite device is a device associated with at least one of an emergency responder and an insurance company.

11. The system of claim 7, wherein the detector comprises a smoke detector.

12. The system of claim 7, wherein the particular stimulus is smoke or fire.

13. The system of claim 7, further comprising a portable device, wherein on detecting the presence of the particular stimulus, the detector transmits a wireless activation signal that is transmitted to and received by the portable device and thereby activates at least one of:

a sound alarm of the portable device;

a continuous projection of light from the portable device; and vibration of the portable device until an input to deactivate the vibrations is received.

14. The system of claim 13, wherein at least one of the portable device and the offsite device comprises a cell phone.

15. The system of claim 13, further comprising a remote control component used to test the detector and/or the portable device.

16. A system comprising:

a detector including a computing system supporting wireless-signal-sending-and receiving functionalities and configured to detect the presence of a particular stimulus; and a cell phone in wireless communication with the detector;

wherein, on detecting the presence of the particular stimulus, the detector transmits a wireless activation signal that is transmitted to and received by the cell phone and thereby activates vibration of the cell phone in response to receipt of the wireless activation signal by the cell phone, wherein the vibration of the cell phone continues until an input to deactivate the vibrations is received by the cell phone.

17. The system of claim 16, wherein the cell phone is configured to also emit a continuous projection of light in response to receiving the wireless activation signal from the detector.

18. The system of claim 16, wherein the cell phone further comprises a remote control component for testing whether the detector is functioning.

19. The system of claim 16, wherein the detector comprises a smoke detector.

20. The system of claim 16, wherein the detector comprises a carbon monoxide detector.

* * * * *